US009707527B2

(12) United States Patent
Takemoto et al.

(10) Patent No.: US 9,707,527 B2
(45) Date of Patent: Jul. 18, 2017

(54) KNEADING APPARATUS WITH ROTARY SHAFTS HAVING KNEADING MEMBERS

(71) Applicant: SHIN NICHINAN CO., LTD., Kitakyushu-shi, Fukuoka (JP)

(72) Inventors: Yusuke Takemoto, Yokohama (JP); Yoichi Kashima, Yokohama (JP); Takahiro Shibuya, Yokohama (JP)

(73) Assignee: SHIN NICHINAN CO., LTD. (JP)

( * ) Notice: Subject to any disclaimer, the term of this patent is extended or adjusted under 35 U.S.C. 154(b) by 75 days.

(21) Appl. No.: 14/418,101

(22) PCT Filed: Jul. 25, 2013

(86) PCT No.: PCT/JP2013/070135

§ 371 (c)(1),
(2) Date: Jan. 29, 2015

(87) PCT Pub. No.: WO2014/021180

PCT Pub. Date: Feb. 6, 2014

(65) Prior Publication Data

US 2015/0165398 A1 Jun. 18, 2015

(30) Foreign Application Priority Data

Jul. 30, 2012 (JP) ..... 2012-168095

(51) Int. Cl.
*B01F 7/04* (2006.01)
*B01F 7/00* (2006.01)
*B01F 7/08* (2006.01)

(52) U.S. Cl.
CPC ..... *B01F 7/048* (2013.01); *B01F 7/001* (2013.01); *B01F 7/00275* (2013.01);
(Continued)

(58) Field of Classification Search
CPC B01F 7/00141; B01F 7/00425; B01F 3/1221; B01F 7/042; B01F 7/022;
(Continued)

(56) References Cited

U.S. PATENT DOCUMENTS 3,719,351 A * 3/1973 Upmeier ..... B29C 47/60 366/82
3,734,468 A * 5/1973 Cheng ..... B01F 7/042 366/300

(Continued)

FOREIGN PATENT DOCUMENTS

DE 0351043 3/1922
DE 1199737 B * 9/1965 ..... B01F 7/00008

(Continued)

OTHER PUBLICATIONS

European Search Report mailed Feb. 17, 2016 issued in European Patent Application No. EP 13 82 6357.

*Primary Examiner* — Charles Cooley
(74) *Attorney, Agent, or Firm* — Adams & Wilks

(57) ABSTRACT

A kneading apparatus has two rotary shafts mounted to undergo rotation in opposite directions at unequal speeds. Cubic-shaped kneading members having the same shape and size are detachably mounted to the rotary shafts so as to be arranged helically with an inverse helix from each other at a predetermined helical pitch and at predetermined angular pitch intervals for kneading an object during rotation of the rotary shafts. Each kneading member has side surfaces extending parallel to a rotational axis of the rotary shaft and front and rear surfaces extending perpendicular to the rotational axis. The side surfaces of each kneading member is curved in the shape of a concave. The rotary shafts are disposed close to one another so that tips of the kneading members on one of the rotary shafts enter into the concave curved surfaces of the opposing kneading members of the
(Continued)

other of the rotary shafts without the opposing kneading members contacting one another during rotation of the rotary shafts.

11 Claims, 8 Drawing Sheets

(52) U.S. Cl.
CPC ..... *B01F 7/00425* (2013.01); *B01F 7/00891* (2013.01); *B01F 7/00975* (2013.01); *B01F 7/042* (2013.01); *B01F 7/043* (2013.01); *B01F 7/047* (2013.01); *B01F 7/085* (2013.01)

(58) Field of Classification Search
CPC .. B01F 7/025; B01F 7/004; B01F 2215/0427; B01F 2215/0422; B01F 2215/0431; B01F 2215/0481; B01F 7/0025; B01F 7/04; B01F 7/088; B01F 7/047; B01F 7/048; B01F 7/081; B01F 7/085; B01F 15/00083; B01F 15/00896; B01F 7/00275; B01F 7/001; B01F 7/00891; B01F 7/043
USPC ..... 366/96–99, 297–301, 171.1, 320, 322, 366/307, 325.1, 325.3, 326.1, 366/327.1–327.3, 328.2, 266; 416/197 R; 422/229
See application file for complete search history.

(56) References Cited

U.S. PATENT DOCUMENTS

| | | | | | |
|---|---|---|---|---|---|
| 4,301,273 | A * | 11/1981 | Sugio | B01F 7/042 | 528/230 |
| 4,556,324 | A * | 12/1985 | Tynan | B01F 7/042 | 366/301 |
| 5,669,710 | A | 9/1997 | Schebesta et al. | 366/97 | |
| 8,770,825 | B2 * | 7/2014 | Takemoto | B01F 3/1221 | 366/298 |
| 2004/0228204 | A1 | 11/2004 | Peters et al. | 366/91 | |
| 2010/0284237 | A1 * | 11/2010 | Takemoto | B01F 3/1221 | 366/85 |
| 2014/0269148 | A1 * | 9/2014 | Takemoto | B01F 7/00141 | 366/97 |
| 2015/0165398 | A1 * | 6/2015 | Takemoto | B01F 7/001 | 366/83 |

FOREIGN PATENT DOCUMENTS

| | | | | |
|---|---|---|---|---|
| EP | 0715881 | | 6/1996 | |
| FR | 0877964 | | 1/1943 | |
| GB | 173457 | A * | 1/1922 | A21C 1/06 |
| JP | 59123520 | | 7/1984 | |
| JP | 60090032 | | 5/1985 | |
| JP | 60239211 | | 11/1985 | |
| JP | 6023251 | | 2/1994 | |
| SU | 1669522 | A1 * | 8/1991 | B01F 7/042 |
| WO | 2009044608 | | 4/2009 | |

* cited by examiner

KNEADING APPARATUS WITH ROTARY SHAFTS HAVING KNEADING MEMBERS

BACKGROUND OF THE INVENTION

Technical Field

The present invention relates to a kneading apparatus, and more specifically to a kneading apparatus in which cubic paddles that are provided on two rotary shafts are caused to rotate to convey every kind of materials while being kneaded.

Background Art

Conventionally, such a kneading apparatus (mixer) has been used in kneading materials and those with liquids added thereto, the materials, for example, including dehydrated sludge, incinerated or collected dust, other types of dust mixed with a solidifier such as cement, or powdery or granular materials such as fertilizer.

Conventionally, such a kneading apparatus is known, as is, for example, disclosed in Patent Document 1, in which two rotary shafts each having a plurality of rods erected so as to be arranged helically with an inverse helix are caused to rotate at unequal speeds to knead and convey materials in one direction. In such a kneading apparatus, the rods are arranged so that the distal ends thereof come in proximity to the external peripheral surface of the facing rotary shaft. Causing the two rotary shafts to rotate makes it possible to scrape off the kneaded object that has adhered to the external peripheral surface of the other rotary shaft, thus performing self-cleaning. Patent Document 1 discloses that such rods may be replaced with flat plate paddles (paragraph [0045]).

Patent Document 2 also discloses a kneading apparatus including a first rotary shaft having a plurality of paddles as stirring members vertically provided on the external periphery thereof so as to be arranged helically at a predetermined helical pitch and at predetermined angular pitch intervals, and a second rotary shaft having a plurality of similar paddles vertically provided so as to be arranged helically with an inverse helix from that of the first rotary shaft at a predetermined helical pitch and at predetermined angular pitch intervals. Also in this kneading apparatus, the first and second rotary shafts are caused to rotate in opposite directions at unequal speeds. The helical pitch ratio of the first and second rotary shafts is set so as to be the inverse of the rotational speed ratio of the first and second rotary shafts, and the angular pitch ratio of the paddles of the first and second rotary shafts so as to be the same as the rotational speed ratio of the first and second rotary shafts.

PRIOR ART DOCUMENTS

Patent Documents

Patent Document 1: Japanese Laid-open Patent Application No. 2006-239554

Patent Document 2: PCT Laid-open Application No. WO2009/044608

The paddles that are provided in the above-mentioned kneading apparatus are all in the form of a flat plate, and are attached at a specified inclined angle (45°) relative to the center axes of the rotary shafts. In such a configuration, the two rotary shafts must be disposed away in order to prevent the paddles facing to each other from colliding. Furthermore, the paddles are plate-shaped, so that the areas of facing paddles are disadvantageously not large enough to compress or crush the materials between the paddles.

The present invention was devised to overcome such problems, and an object thereof is to provide a kneading apparatus being capable of sufficiently compressing or crushing the materials between the facing paddles, thereby dissolving lumps.

SUMMARY OF THE INVENTION

The present invention is characterized by an kneading apparatus for kneading an object to be kneaded by rotating two rotary shafts that are disposed in parallel and rotate at unequal speeds in the direction opposite to each other, paddles as kneading members being disposed respectively thereon in a facing manner so as to be arranged helically with an inverse helix from each other at a predetermined helical pitch and at predetermined angular pitch intervals, wherein a helical pitch ratio of the paddles on the rotary shafts is set so as to be the inverse of a rotational speed ratio of both the rotary shafts and an angular pitch ratio so as to be the same as the rotational speed ratio thereof;

the paddles of both the rotary shafts are cubic paddles each having on right and left sides surfaces extending parallel to the axis of the rotary shaft, on front and rear sides surfaces perpendicular to the axis thereof, and on upper and lower sides surfaces extending parallel to the axis thereof; and the surfaces on the right and left sides of the paddles are concavely curved to form curved surfaces, and both the rotary shafts are disposed in proximity so that, when rotated, the upper side surface of each of the paddles can enter into the curved surfaces formed on the right and left surfaces of the facing paddle.

In the present invention, the concavely curved surfaces are formed at the right and left surfaces (both side surfaces) of the paddle, and the rotary shafts are disposed in proximity so that the upper surface (distal surface) of the paddle can enter into the curved surfaces of the facing paddle. This allows the rotary shafts to come close to a great extent. Therefore, the dust-shaped or powdery or granular materials between the paddles can be compressed into high density and kneaded into appropriately lumped materials. A high destroying pressure further acts between the paddles that come in proximity. This ensures that too large lump materials can be crushed, thus dissolving the aggregated lumps. Since the paddles are cubic, the facing paddles are greater in area than the flat plate paddles, improving the compressing and crushing effects.

The distal surfaces and the curved surfaces of the paddles on both the rotary shafts come in proximity to each other, so that the kneaded object that has adhered to the distal surface or the curved surface thereof can be scraped off by the facing paddle, thus providing a high self-cleaning effect.

DETAILED DESCRIPTION OF THE PREFERRED EMBODIMENTS

Figure 1:
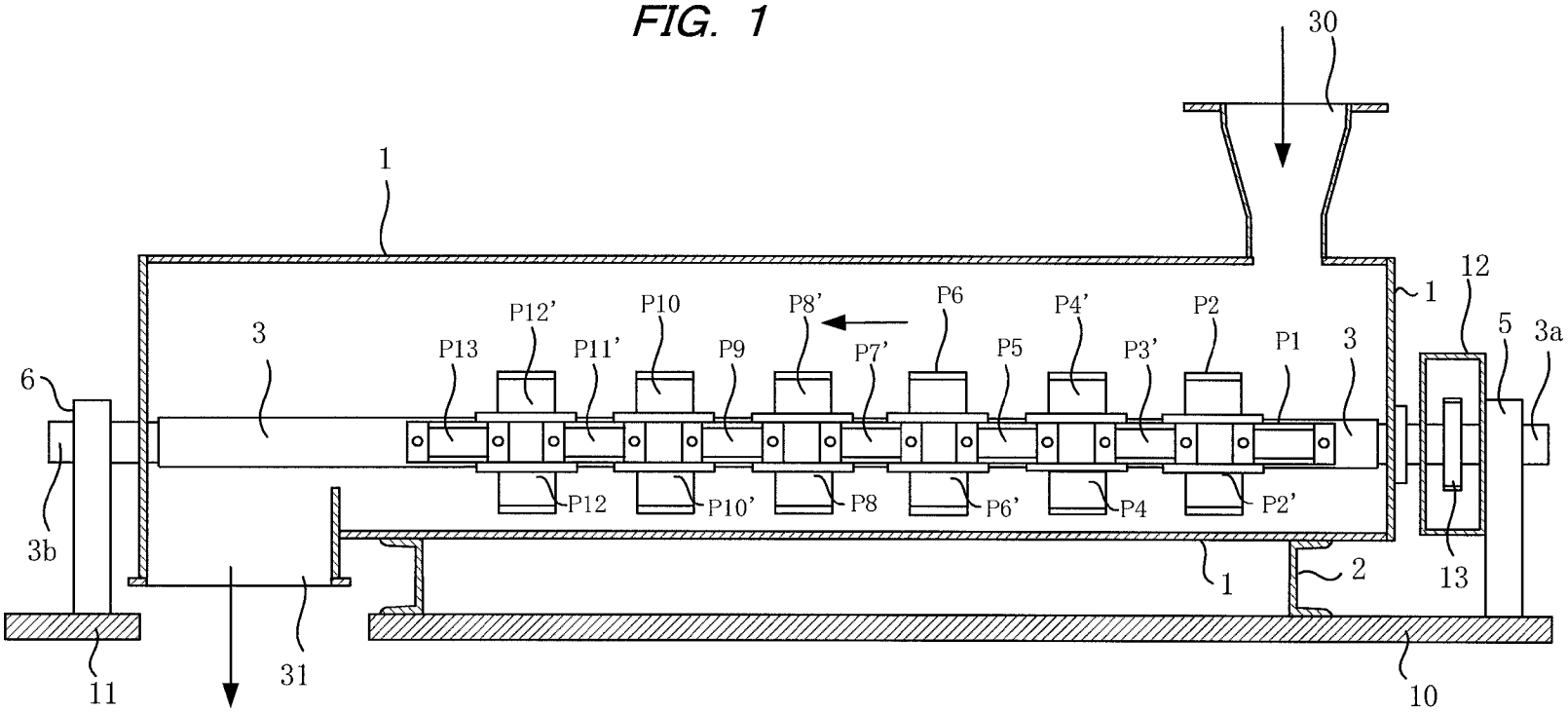
FIG. 1 is a vertical cross-sectional view of an kneading apparatus showing paddles as viewed laterally, which are disposed in one rotary shaft in the housing thereof.

A kneading apparatus of the present invention will now be described in detail based on embodiments shown in the drawings.

Embodiments

Figure 2:
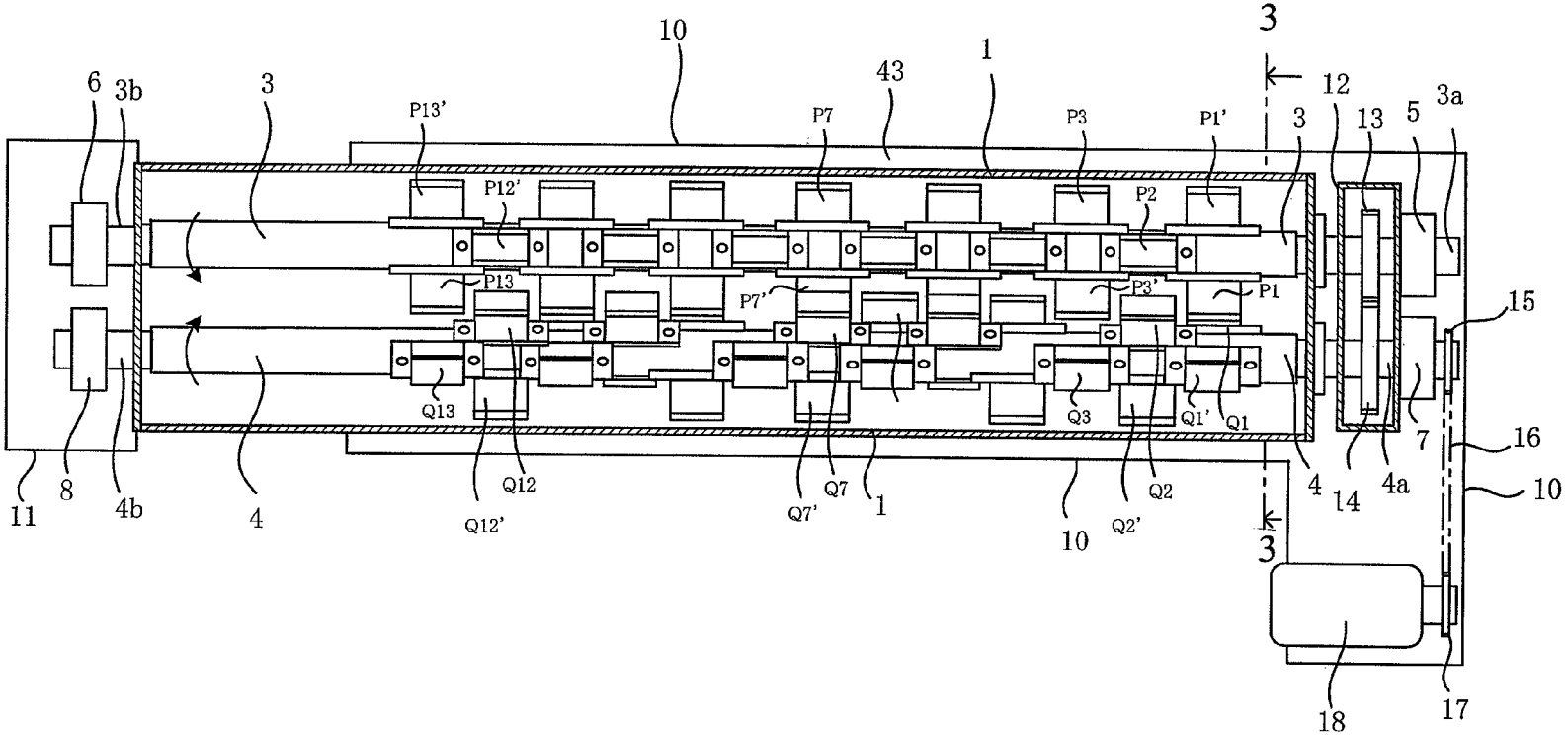
FIG. 2 is a top view of a kneading apparatus showing paddles that are arranged on rotary shafts with a large part of the top of the housing removed therefrom.
Figure 3:
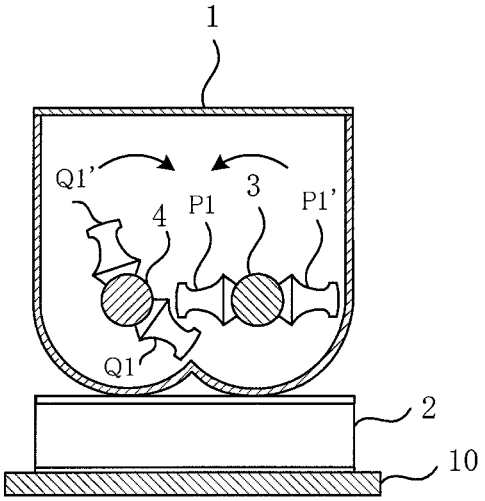
FIG. 3 is a cross-sectional view along line 3-3 in FIG. 2.

FIGS. 1 through 3 show the structure of a kneading apparatus according to an embodiment of the present invention. FIG. 1 is a vertical cross-sectional view of a kneading apparatus showing paddles as viewed laterally, which are disposed in one rotary shaft in the housing thereof, FIG. 2 is a top view of a kneading apparatus showing paddles that are arranged on two rotary shafts with a large part of the top of the housing removed therefrom, and FIG. 3 is a cross-sectional view along line 3-3 in FIG. 2.

In FIGS. 1 through 3, reference numeral 1 indicates a housing of the kneading apparatus, which is provided horizontally on frames 2 mounted on a base 10. The housing 1 is made of metal such as stainless steel, and is formed into a long, thin, rectangular parallelepiped shape. As shown in FIG. 3, the housing 1 is at the lower part thereof in the form of an arc corresponding to a circle that the distal ends of the paddles on rotary shafts 3 and 4 draw.

At the top of the right end shown in FIG. 1, a supply opening 30 is provided for supplying dust-shaped or powdery or granular material (an object to be kneaded) from a hopper (not shown) into the housing 1. At the bottom of the left end, a discharge opening 31 is provided for discharging the kneaded object from the housing 1 onto a conveyor belt (not shown). Although not shown, the housing 1 is, as needed, provided at the upper portion thereof with a supply opening for supplying a liquid medicine or a solvent that is injected into the object to be kneaded.

Inside the housing 1, two rotary shafts 3 and 4 of the same diameter are provided in parallel to each other in the longitudinal direction. The rotary shafts 3 and 4 are made of metal such as stainless steel, and are circular in cross-section. The rotary shaft 3 is smaller in diameter at right and left ends 3*a* and 3*b* thereof, which protrude outwardly from the housing 1 and are rotatably supported by bearings 5 and 6 fixed to the bases 10 and 11. The rotary shaft 4 is also smaller in diameter at right and left ends 4*a* and 4*b* thereof, which protrude outwardly from the housing 1 and are rotatably supported by bearings 7 and 8 fixed to the bases 10 and 11.

The rotary shafts 3 and 4 have their right ends 3*a* and 4*a* in FIGS. 1 and 2 inserted into a gear box 12. Gears 13 and 14 that mesh with each other are fixed to the right ends 3*a* and 4*a* of the rotary shafts 3 and 4 inside the gear box 12.

A sprocket 15 is fixed to the outside of the bearing 7 of the rotary shaft 4. A motor 18 is mounted on the base 10, and a sprocket 17 is fixed to the output shaft thereof. A chain 16 is stretched between the sprockets 15 and 17.

A unidirectional rotational drive force from the motor 18 is transmitted to the rotary shaft 4 via the sprocket 17, the chain 16 and the sprocket 15, causing the rotary shaft 4 to rotate in one direction, and the rotational drive force is also transmitted to the rotary shaft 3 via the gears 14 and 13, causing the rotary shaft 3 to rotate in the opposite direction. The rotary shafts 3 and 4 are caused to rotate via the gears 13 and 14 at an unequal rate with a rotational speed ratio of N:N−1, wherein N is an integer which is two or more. For example, N is set to 2 through 6, and, in the present invention, N is set to 5. The rotary shafts 3 and 4 are caused to rotate with a rotational speed ratio of e.g., 5:4. The rotating directions of the rotary shafts 3 and 4 are such that the shafts rotate inward towards each other when viewed from above, as seen in FIGS. 2 and 3.

Paddles P1 to P13, P1' to P13', Q1 to Q13, and Q1' to Q13', serving as kneading members, are provided on the external peripheries of the rotary shafts 3 and 4. In FIG. 2, only some of the paddles are shown by symbols in order to keep the drawings from becoming too complex. Hereinafter, the paddles P1 to P13, P1' to P13', Q1 to Q13, and Q1' to Q13' are also expressed as the paddles Pn, Pn', Qn, and Qn' with n being 1 to 13.

The paddles Pn, Pn', Qn, and Qn' all have the same shape, and are made of the same material, e.g., metal such as stainless steel. Typically, the paddle P1 is shown in FIGS. 4 and 5. Hereinafter, the paddle P1 attached to the rotary shaft 3 is representatively described with reference number 20. The description will applies also to the other paddles Pn, Pn', Qn, and Qn' and the rotary shafts to which they are attached.

The paddle 20 is integrated by welding with a metallic mount 21 for attaching it to the rotary shaft. At the mount 21, bolt bores 22 and 23 are provided for attaching the paddle to the rotary shaft.

Figure 4A:
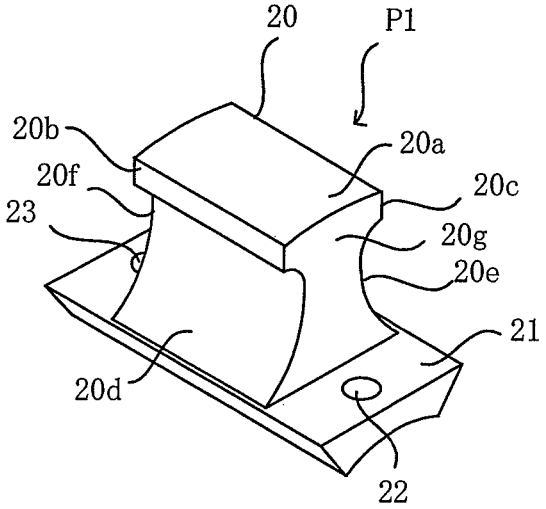
FIG. 4*a* is a perspective view showing the appearance of a paddle.
Figure 4B:
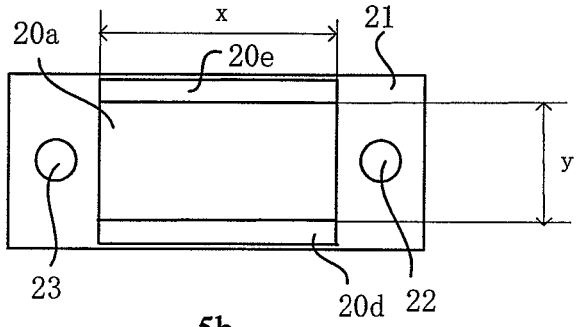
FIG. 4*b* is a top view of the paddle.
Figure 4C:
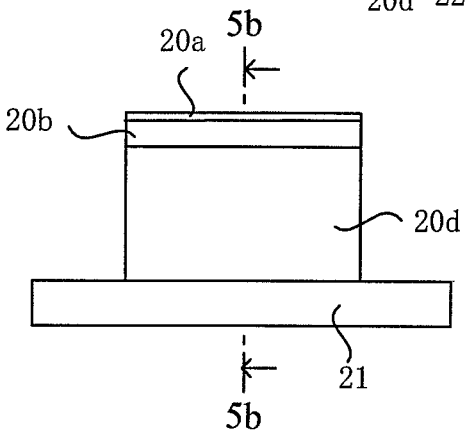
FIG. 4*c* is a side view showing the right or left surface of the paddle along the axial direction of the rotary shaft.
Figure 4D:
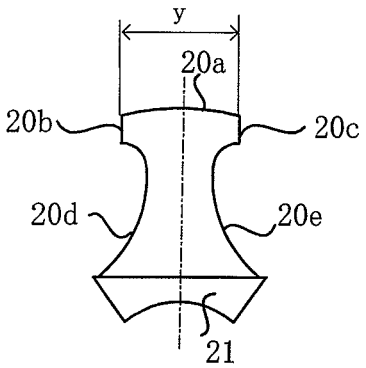
FIG. 4*d* is a side view showing the front or rear surface of the paddle orthogonal to the rotary shaft.

As shown in FIGS. 4*a* to 4*d*, 5*a* and 5*b*, the paddle 20 is a cubic paddle having on right and left sides surfaces extending parallel to the axis Z-Z' of the rotary shaft, on front and rear sides surfaces perpendicular to the axis thereof and on upper and lower sides surfaces extending parallel to the axis thereof. The upper surface 20*a* of the paddle 20 forms a distal surface thereof, slightly convexly curved, and the length x thereof along the rotary shaft is longer than the length (width) y along the rotational direction thereof. The right and left side surfaces parallel to the axis Z-Z' extending in the axial direction of the rotary shaft forms both side surfaces of the paddle. The upper portions 20*b* and 20*c* of the side surfaces extend vertically downward, once curved concavely inward, then extending continuously to curved surfaces 20*d* and 20*e*. The curved surfaces 20*d* and 20*e* have a large curvature (a small radius of curvature) on the side of the upper surface 20*a* of the paddle, and a small curvature (a large radius of curvature) on the side of the mount 21 (the lower surface side). The front and rear surfaces 20*f* and 20*g* of the paddle 20 perpendicular to the axis Z-Z' are vertical, respectively. The paddle 20 has its both right and left side surfaces curved concavely with different curvatures, so that it is rail-shaped as seen in a railroad. As shown in FIG. 4*d*, the paddle 20 is thus in the form of a block having plane symmetry in right and left relative to a vertical plane passing through the center of the circumferential direction of the mount 21 (the axis Z-Z' of the rotary shaft).

The curved surfaces 20*d* and 20*e* formed on both the sides of the paddle may have the same curvature at all locations, or may be variable in curvature not only at two locations as describe above, but also variable at locations more than two so as to be gradually small in curvature as they come near to the side of the mount 21.

Figure 5A:
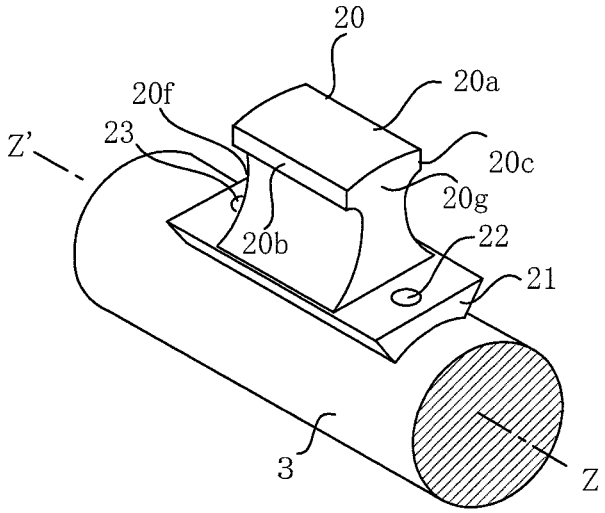
FIG. 5*a* is a perspective view showing how the paddle is attached to the rotary shaft.
Figure 5B:
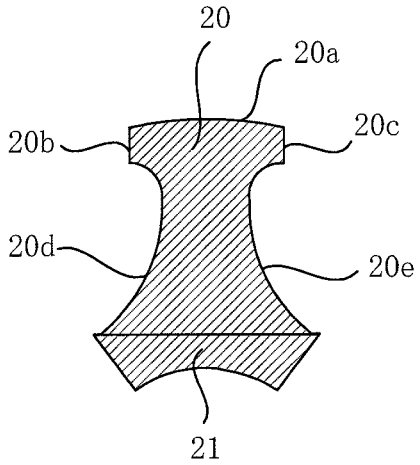
FIG. 5*b* is a cross-sectional view showing a cross-section passing through the axis along line 5*b*-5*b* in FIG. 4*c;*

FIGS. 5*a* and 5*b* show how the paddle 20 is attached to the rotary shaft 3. The paddle 20 is attached thereto by bolts via the bolt bores 22 and 23 so that the right and left vertical side surfaces 20*b* and 20*c* may be parallel to the axis Z-Z' of the rotary shaft 3 and the front and rear surfaces 20*f* and 20*g* may be perpendicular to the axis Z-Z' thereof.

Figure 6:
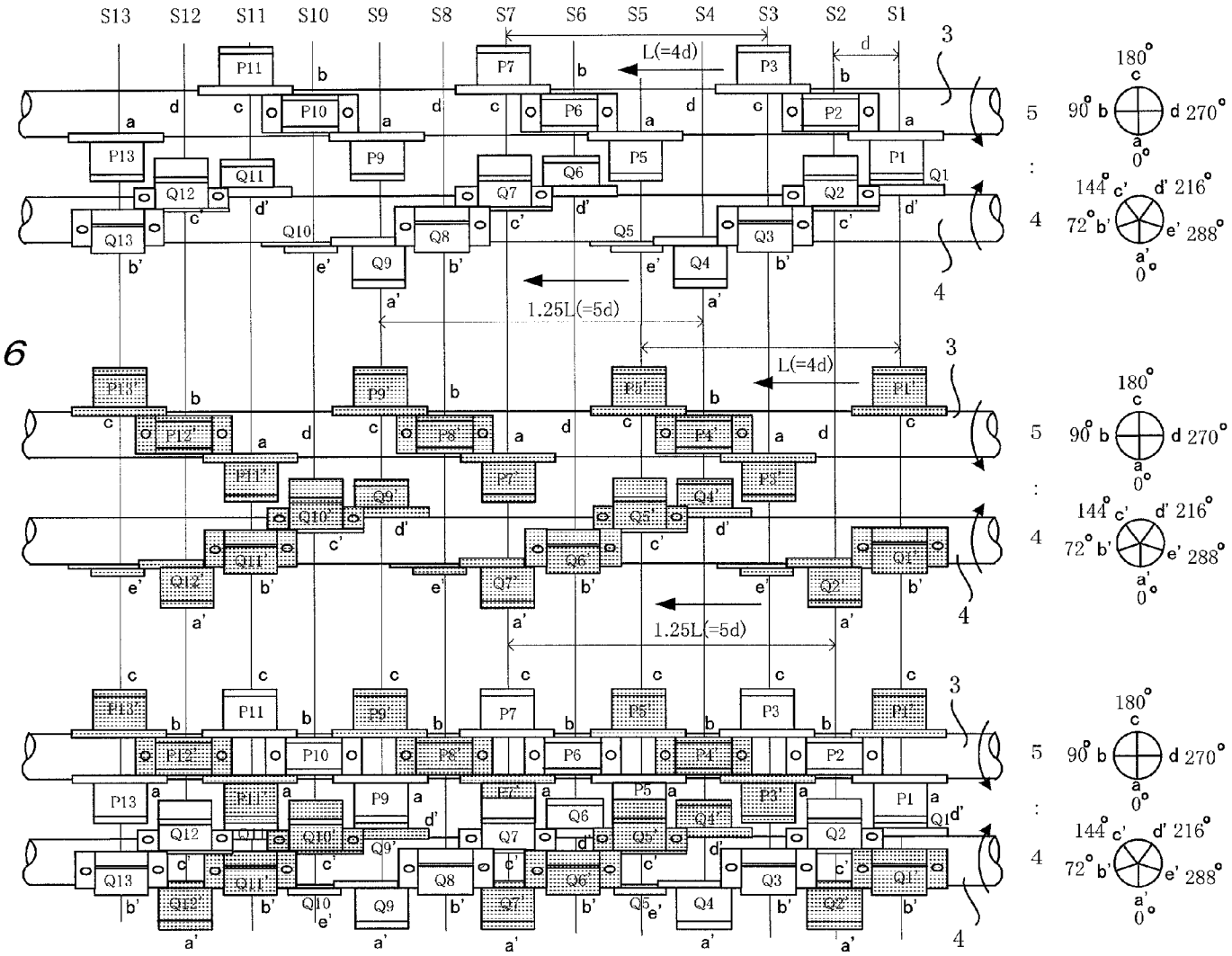
FIG. 6 is an illustrative view showing how the paddles are attached to the rotary shafts.

The paddles Pn, Pn', Qn, and Qn' (n=1 to 13) are arranged helically on the external peripheries of the rotary shafts 3 and 4 at a predetermined helical pitch and at a predetermined angular pitch with an offset to each other in the circumferential directions (rotational directions) of the rotary shafts. This is shown in the lower portion of FIG. 6. The attachment state shown in the lower portion of FIG. 6 corresponds to that as shown in FIG. 2. How the paddles are attached is complicate at the lower portion in FIG. 6 or in FIG. 2. Therefore, for simplicity, only the paddles Pn and Qn are shown in the upper portion of FIG. 6 to illustrate how they are arranged, and only the paddles Pn' and Qn' are shown in the center of FIG. 6 to illustrate how they are arranged. To make the arrangement clear, the paddles Pn' and Qn' are illustrated by dots.

In FIG. 6, angles are shown on the right side thereof. The angle of 0 degree indicates an angle along a line extending vertically downward from the centers of the rotary shafts 3 and 4 in FIG. 6 (horizontally leftward in FIG. 3), and the other angles are respectively shown along the circumference of the rotary shaft when rotated clockwise. S1 to S13 indicate axial positions of the rotary shafts at which the paddles are attached thereon, and the axial position of the rotary shaft at which the paddle is attached is equidistant d from the adjacent attachment position. The axial positions S1 to S13 indicate positions each passing through the axial center of the paddle.

As will be described below, the paddles Pn and Qn are attached to the rotary shafts 3 and 4 with an inverse helix from each other at angular pitches whose ratio is the same as the rotational speed ratio of the rotary shafts 3 and 4 and at helical pitches whose ratio is the inverse of the rotational speed ratio of the rotary shafts 3 and 4.

The paddle P1 is, as shown in the upper paddle arrangement in FIG. 6, attached at the axial position S1 and at an angular position of 0 degree (a), the paddle P2 at the position S2 and at an angular position of 90 degrees (b) with an angular pitch offset of 90 degrees from the angular position of the paddle P1 in the direction opposite to the rotational direction of the rotary shaft 3 (hereinafter referred to as clockwise), the paddle P3 at the position S3 and at an angular position of 180 degrees (c) with a further clockwise offset of 90 degrees from the angular position of the paddle P2, and the paddle P4 at the position S4 and at an angular position of 270 degrees (d) with a further clockwise offset of 90 degrees from the angular position of the paddle P3 (the paddle P4 is invisible because it appears on the reverse side of the drawing). Similarly, the paddles P5 to P13 are respectively attached at the positions S5 to S13 with a clockwise offset of 90 degrees, respectively. The paddles Pn are thus arranged with a 90 degrees clockwise offset whenever they shift (move) distance d in the axial direction, so that the arrangement of the paddles Pn is helical with a helical pitch L (=4d). Such a paddle arrangement in which the paddles are helically arranged at a predetermined helical pitch (L) and at a predetermined angular pitch interval (90 degrees) is referred to as a single helix arrangement in this specification.

When the rotary shaft 3 rotates in the direction as indicated by the arrow, the screw function due to the single helix arrangement causes an object to be kneaded to be conveyed leftward as viewed in FIG. 6 as indicated by the arrow.

On the other hand, the paddle Q1 is, as shown in the upper paddle arrangement in FIG. 6, attached at the axial position S1 of the rotary shaft 4 and at an angular position of 216 degrees (d'), the paddle Q2 at the position S2 and at an angular position of 144 degrees (c') with an angular pitch offset of 72 degrees from the angular position of the paddle Q1 in the direction opposite to the rotational direction of the rotary shaft 4 (hereinafter referred to as counterclockwise). The paddle Q3 is attached at the position S3 and at an angular position of 72 degrees (b') with a further counterclockwise offset of 72 degrees from the angular position of the paddle Q2, the paddle Q4 at the position S4 and at an angular position of 0 degree (a') with a further counterclockwise offset of 72 degrees from the angular position of the paddle Q3, and the paddle Q5 at the position S5 and at an angular position of 288 degrees (e') with a further counterclockwise offset of 72 degrees from the angular position of the paddle Q4. Similarly, the paddles Q6 to Q13 are respectively attached at the positions S6 to S13 with a counterclockwise offset of 72 degrees, respectively.

The paddles Qn are thus arranged with a 72 degrees counterclockwise offset whenever they move distance d in the axial direction, so that the paddles Qn has a helical pitch 1.25 L (=5d), and are arranged with this helical pitch and with an angular pitch interval of 72 degrees. Such a paddle arrangement is a single helix arrangement with an inverse helix from that of the paddles Pn. When the rotary shaft 4 rotates in the direction as indicated by the arrow, the screw function due to the single helix arrangement causes the object to be kneaded to be conveyed similarly leftward as indicated by the arrow. The helical pitch is 1.25 L (=5d) that is the inverse of the rotational speed ratio, so that the conveyance speed by the paddles Qn is the same as that by the paddles Pn.

Since the ratio of the 90 degrees angular pitch (angular offset) of the paddles Pn and the 72 degrees angular pitch of the paddles Qn is the same as the rotational speed ratio 5:4 of the rotary shafts 3 and 4, the rotary shaft 4 rotates (4/5)*n times when the rotary shaft 3 rotates n times, and the angular position of each of the facing paddles Pn and Qn is the same as that before the rotary shaft 3 rotates n times. As will be described hereinafter in reference to FIG. 7, the mutual angular relation of the paddles Pn and Qn that face in accordance with the rotation of the rotary shafts 3 and 4 is repeated cyclically, causing no shift in angular phase.

In the present embodiment, as shown in the middle paddle arrangement in FIG. 6, the paddle P1' is attached at the position S1 of the rotary shaft 3 at which the paddle P1 is attached and at an angular position that is offset clockwise by an angular pitch of 180 degrees from that of the paddle P1. Similarly, the paddles Pn' (n=2 to 13) are attached at the positions Sn (n=2 to 13) of the rotary shaft 3 at which the paddles Pn (n=2 to 13) are attached and at angular positions that are offset clockwise by the angular pitch of 180 degrees from those of the paddles Pn (n=2 to 13).

Thus, the paddles Pn' are attached at the positions that are the same as the axial positions Sn of the paddles Pn and at angular positions that are different from those of the paddles Pn attached thereto by 180 degrees, i.e., twice the angular pitch of 90 degrees in the helical arrangement of the paddles Pn. The arrangement of the paddles Pn' is another single helix, and the paddles are thus attached to the rotary shaft 3 with a double helix arrangement. The double helix arrangement on the rotary shaft 3 is shown at the bottom in FIG. 6 and in FIG. 2, although it is complicated.

Similarly, as shown in the middle paddle arrangement in FIG. 6, the paddle Q1' is attached at the position S1 of the rotary shaft 4 at which the paddle Q1 is attached and at an angular position that is offset counterclockwise by an angular pitch of 144 degrees from that of the paddle Q1. Similarly, the paddles Qn' (n=2 to 13) are attached at the positions Sn (n=2 to 13) of the rotary shaft 4 at which the paddles Qn (n=2 to 13) are attached and at angular positions that are offset counterclockwise by the angular pitch of 144 degrees from those of the paddles Qn (n=2 to 13).

The paddles Qn' are attached at the positions that are the same as the axial positions Sn of the paddles Qn and at angular positions that are different from those of the paddles Qn attached thereto by 144 degrees, i.e., twice the angular pitch of 72 degrees in the helical arrangement of the paddles Qn. The arrangement of the paddles Qn' is another single helix to provide such a double helix arrangement as is on the rotary shaft 3. The paddles on the rotary shaft 4 with the double helix arrangement are shown at the bottom in FIG. 6 and in FIG. 2.

With n=1 to 13, the paddles Pn' and Qn', similarly to the paddles Pn and Qn, are attached to the rotary shafts 3 and 4 at the angular pitches whose ratio is the same as the rotational speed ratio of the rotary shafts 3 and 4 and at the helical pitches whose ratio is the inverse of the rotational speed ratio thereof. Therefore, when the rotary shafts 3 and 4 rotate in the direction as shown by the arrows, the screw function due to the double helix arrangement of the paddles on the rotary shafts causes the object to be kneaded to be conveyed leftward in FIG. 6 as shown by the arrow at the same speed with a conveyance power greater than due to the single helix arrangement.

The rotary shafts 3 and 4 are disposed in proximity so that the distal surfaces (20*a*) of the paddles on the one rotating rotary shaft can enter into the curved surfaces (20*d*, 20*d*) of the paddles on the other facing rotary shaft without any contact therewith.

Next, the operation of the kneading apparatus thus configured will be described.

When the motor 18 is driven, the rotary shafts 3 and 4 rotate inward at unequal speeds in opposite directions at a rotational speed ratio of N:N−1 (5:4 in the embodiment), as described above.

In this state, an object to be kneaded is supplied from the supply opening 30. The object to be kneaded is kneaded by the paddles that rotate in accordance with the rotation of the rotary shafts 3 and 4, and are conveyed toward the discharge opening 31 by the screw function due to the double helix arrangement of the paddles. As shown in FIGS. 4*a* to 4*d*, FIGS. 5*a* and 5*b*, the paddles have the inward curved surfaces (20*d*, 20*e*) at the two side surfaces extending in the axial direction, so that the distal surface (20*a*) of the paddle can enter into the curved surfaces of the facing paddle. This allows the rotary shafts 3 and 4 to be disposed in closer proximity, making the spacing between the paddles small when the facing paddles come near. Therefore, the dust-shaped or powdery or granular materials between the paddles can be compressed into high density and kneaded into appropriately lumped materials. A high destroying pressure further acts between the paddles that are coming in proximity. This ensures that too large lump materials can be crushed, thereby dissolving the aggregated lumps. Furthermore, the distal surfaces and the curved surfaces of the paddles on the rotary shafts come in proximity to each other, so that the kneaded object that has adhered to the distal surface or the curved surface thereof can be scraped off by the facing paddle, thus performing high self-cleaning.

Figure 7:
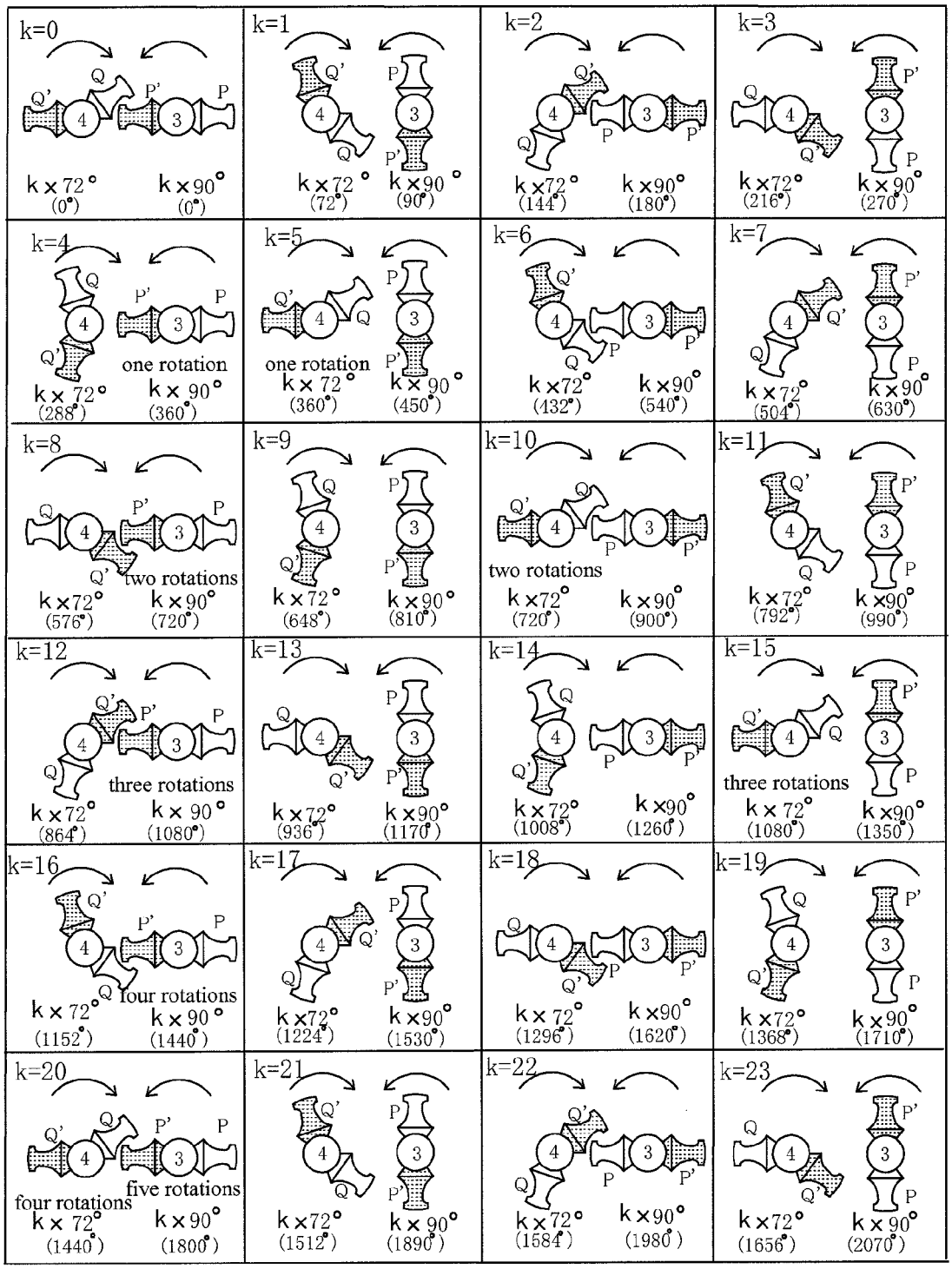
FIG. 7 is an illustrative view showing how the paddles rotate when the rotary shafts rotate.
Figure 8:
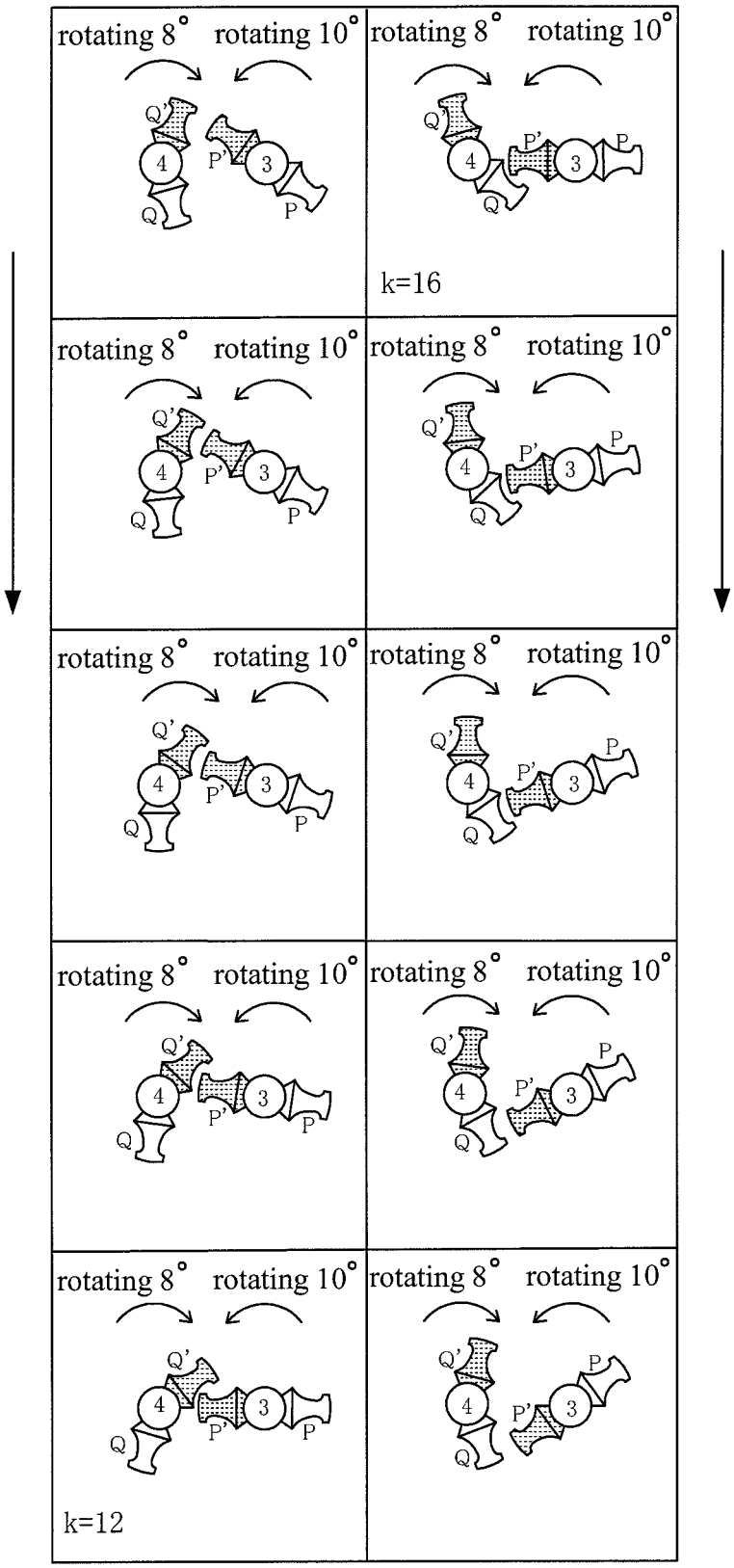
FIG. 8 is an illustrative view showing at sub-divided rotational angles how the paddles rotate when the rotary shafts rotate.

This is shown in FIGS. 7 and 8. In FIG. 7, with k=0 to 23, the rotary shaft 3 rotates 90 degrees in increments of 1, and the rotary shaft 4 rotates 72 degrees at the same ratio as the rotational speed ratio 5:4 of both the rotary shafts. The total numbers of rotations of the rotary shafts 3 and 4 are shown at the bottom of the rectangle with each value of k. The phases of the paddles at k=0 are those as viewed from the right when they are located at S7 in FIG. 2 and at the lower in FIG. 6. The paddles of the rotary shaft 3 are indicated by P and P', and the paddles of the rotary shaft 4 by Q and Q'. The illustration of the paddles by dots correspond to that in FIG. 2 and at the lower portion in FIG. 6.

FIG. 8 shows how the facing paddles approach when the rotary shaft 4 rotate in 8 degrees increments and the rotary shaft 3 rotates in 10 degrees increments in the opposite direction. FIG. 8 shows on the left side thereof the rotational state up to k=12 in FIG. 7 and on the right side the rotational state from k=16.

As shown in FIG. 7, when the rotary shafts 3 and 4 respectively rotate 5 and 4 times (k=20), they have the same phases as those of no rotation (k=0). This forms one period, and the phases during the period are repeated cyclically. During k=0 to 20, the paddles facing to each other approach at k=0, 2, 6, 8, 10, 12, 16 and 18.

As to the paddle P, the distal end thereof approaches one of the curved surfaces of the paddle Q' at k=2 and the other curved surface at k=18. Its distal end approaches the one curved surface of the paddle Q at k=6 and the other curved surface at k=10.

As to the paddle P', the distal end thereof approaches the one curved surface of the paddle Q at k=0 and the other curved surface at k=16. Its distal end approaches the one curved surface of the paddle Q' at k=8 and the other curved surface at k=12.

As to the paddle Q, the distal end thereof approaches the one curved surface of the paddle P' at k=0 and the other curved surface at k=16. Its distal end approaches the one curved surface of the paddle P at k=6 and the other curved surface at k=10.

As to the paddle Q', the distal end thereof approaches the one curved surface of the paddle P' at k=8 and the other curved surface at k=12. Its distal end approaches the one curved surface of the paddle P at k=2 and the other curved surface at k=18.

Thus, each of the curved surfaces of the paddles P, P', Q and Q' approaches the distal end of the facing paddle twice during one period of k=0 to 20. The approach of the facing paddles performs high compressing and crushing effects as described above. Since the paddles are cubic, the facing paddles are larger in area than the flat plate paddles, further improving the compressing and crushing effects.

Furthermore, rotating the paddles allows the kneaded objects adhered to the curved surface to be scraped off, performing the self-cleaning of the curved surface. The self-cleaning for the curved surface is performed similarly for the upper surface (20*a*) of the facing paddle that approaches the curved surface thereof.

Such compressing, crushing and self-cleaning effects are performed similarly for all the paddles that are disposed at S1 to S13, remarkably improving the effects as a whole.

The curvature of the curved surface of the paddle is made large at the distal end of the paddle and small on the side of the rotary shaft on which the paddle is mounted. This allows the distal end of the paddle to come in close proximity to the curved surface of the facing paddle without any collision of the paddles with each other, as shown at k=12 and k=16 in FIG. 8. This further enhances the above-described effects.

The paddle is made longer in length (x) along the axial direction than in length (y) along the rotational direction. This allows the contact area of the kneaded object with the side surface of the paddle to be made great in the axial direction, enhancing the above-described effects.

In the above-mentioned embodiment, the attachment angles of the two paddles at the same axial positions in the double helix arrangement on the rotary shafts are offset by 180 degrees twice the angle pitch 90 degrees on the rotary shaft 3 and by 144 degrees twice the angle pitch 72 degrees on the rotary shaft 4. The offsets of the attachment angles may be respectively n times the angle pitch (n is a positive integer more than one) in the single helix arrangement, except for n such as the double helix is made equal to the single helix (multiple of n=4 for the rotary shaft 3 and multiple of n=5 for the rotary shaft 4). The n of n times in the rotary shaft 3 may be different from the n of n times in the rotary shaft 4. Anyway, it is preferable that two paddles at the same axial positions are attached as far on the opposite side on the rotary shaft as possible, such as 180 degrees twice for the rotary shaft 3 and 144 degrees also twice or 216 degrees triple for the rotary shaft 4, as in the above embodiment. In a case where the angular pitches on the rotary shafts 3 and 4 in the single helix arrangement are, for example, 45 degrees and 36 degrees whose ratio is the same as the rotational speed ratio, it may be preferably 180 degrees four times for the rotary shaft 3 and 180 degrees five times for the rotary shaft 4.

The paddles on the rotary shafts 3 and 4 may be attached not only in the double helix arrangement, but also in the single helix arrangement, as shown at the upper and the middle in FIG. 6. In this case, the number of times that the paddles come close is less than in the double helix arrangement, but the distal end of each of the paddles on the one rotary shaft can cyclically enter into the concavely curved surface of the paddle on the other rotary shaft for periods in which the angular phases of the paddles vary cyclically, as shown at k=6 and 10 or k=8 and 12 in FIG. 7, thereby providing the similar effects.

KEY TO SYMBOLS

1 Housing
2 Frame
3, 4 Rotary shafts
5, 6, 7, 8 Bearings
10, 11 Bases
12 Gear box
13, 14 Gears
15, 17 Sprockets
16 Chain
18 Motor
20 Paddle
21 Mount
30 Supply opening
31 Discharge opening

The invention claimed is:

1. A kneading apparatus for kneading an object to be kneaded by rotating two rotary shafts that are disposed in parallel and rotate at unequal speeds in opposite directions to each other, and paddles as kneading members being disposed on the respective rotary shafts in a facing manner so as to be arranged helically with an inverse helix from each other at a predetermined helical pitch and at predetermined angular pitch intervals, wherein a helical pitch ratio of the paddles on the rotary shafts is set so as to be the inverse of a rotational speed ratio of both the rotary shafts and an angular pitch ratio so as to be the same as the rotational speed ratio thereof;

wherein all of the paddles of both of the rotary shafts have the same shape and size and are cubic paddles each having on right and left sides surfaces extending parallel to the axis of the corresponding rotary shaft, on front and rear sides surfaces perpendicular to the axis thereof, and on upper and lower sides surfaces extending parallel to the axis thereof;

wherein the surfaces on the right and left sides of the paddles are concavely curved to form curved surfaces, and both of the rotary shafts are disposed in proximity to one another so that, when rotated, the upper side surface of each of the paddles on one of the rotary shafts can enter into the curved surfaces formed on the right and left surfaces of the facing paddle on the other of rotary shafts without any contact therewith;

wherein the paddles are detachably mounted to a corresponding rotary shaft such that their right and left side surfaces are parallel to the axis of the rotary shaft and their front and rear surfaces are perpendicular to the axis thereof; and wherein the paddles are longer in length along the axial direction than in length along the rotational direction.

2. A kneading apparatus according to claim 1, wherein the curvature of the curved surfaces of the paddles is large at upper surface portions thereof and small at lower surface portions thereof.

3. A kneading apparatus according to claim 2, wherein, with a helical paddle arrangement on the rotary shaft referred to as a single helix arrangement, the paddles are attached at positions that are the same as the axial positions of the rotary shafts and at angular positions each different from the attachment angles of the paddles attached thereto by an angle that is a predetermined factor times the angle pitch in the single helix arrangement, thereby providing another single helix arrangement so that the paddle arrangement on each of the rotary shafts is a double helix arrangement.

4. An A kneading apparatus according to claim 1, wherein, with a helical paddle arrangement on the rotary shaft referred to as a single helix arrangement, the paddles are attached at positions that are the same as the axial positions of the rotary shafts and at angular positions each different from the attachment angles of the paddles attached thereto by an angle that is a predetermined factor times the angle pitch in the single helix arrangement, thereby providing another single helix arrangement so that the paddle arrangement on each of the rotary shafts is a double helix arrangement.

5. A kneading apparatus according to claim 1, wherein for each of the two rotary shafts, the paddles are mounted on the rotary shaft with a double helix arrangement.

6. A kneading apparatus according to claim 5, wherein for each of the two rotary shafts, the double helix arrangement is formed of a first group of the paddles mounted on the rotary shaft with a first single helix arrangement and a second group of the paddles mounted on the rotary shaft with a second single helix arrangement with an inverse helix from that of the first single helix arrangement.

7. A kneading apparatus comprising:

a pair of rotary shafts mounted to undergo rotation in opposite directions at unequal speeds; and a plurality of cubic-shaped kneading members having the same shape and size and being detachably mounted to the rotary shafts so as to be arranged helically with an inverse helix from each other at a predetermined helical pitch and at predetermined angular pitch intervals for kneading an object during rotation of the rotary shafts, each of the plurality of cubic-shaped kneading members having side surfaces extending parallel to a rotational axis of the rotary shaft and front and rear surfaces extending perpendicular to the rotational axis, the side surfaces of each of the plurality of cubic-shaped kneading members being curved in the shape of a concave, each of the plurality of cubic-shaped kneading members being longer in length along the rotary shaft than in length along a rotational direction thereof, and the rotary shafts being disposed close to one another so that tips of the kneading members on one of the rotary shafts enter into the concave curved surfaces of the opposing kneading members of the other of the rotary shafts without the opposing kneading members contacting one another during rotation of the rotary shafts.

8. A kneading apparatus according to claim 7, wherein each of the plurality of cubic-shaped kneading members comprises a paddle.

9. A kneading apparatus according to claim 7, wherein a helical pitch ratio of the plurality of cubic-shaped kneading members on the rotary shafts is set so as to be the inverse of a rotational speed ratio of both rotary shafts and an angular pitch ratio so as to be the same as the rotational speed ratio thereof.

10. A kneading apparatus according to claim 7, wherein each of the plurality of cubic-shaped kneading members has upper and lower side surfaces extending parallel to the rotational axis.

11. A kneading apparatus according to claim 7, wherein the curvature of the curved surfaces of the plurality of cubic-shaped kneading members is larger at the upper side surfaces than at the lower side surfaces.

* * * * *